US007350886B2

(12) United States Patent
Antos et al.

(10) Patent No.: US 7,350,886 B2
(45) Date of Patent: Apr. 1, 2008

(54) REFRIGERATION STORAGE BIN INCLUDING FLIP-TOP COVER

(75) Inventors: John M. Antos, Ann Arbor, MI (US); Wilco Wessels, AE Ulvenhout (NL)

(73) Assignee: Thetford Corporation, Ann Arbor, MI (US)

( * ) Notice: Subject to any disclaimer, the term of this patent is extended or adjusted under 35 U.S.C. 154(b) by 394 days.

(21) Appl. No.: 10/493,358

(22) PCT Filed: Oct. 21, 2002

(86) PCT No.: PCT/US02/33555

§ 371 (c)(1),
(2), (4) Date: Nov. 19, 2004

(87) PCT Pub. No.: WO03/036202

PCT Pub. Date: May 1, 2003

(65) Prior Publication Data

US 2005/0073226 A1 Apr. 7, 2005

Related U.S. Application Data

(60) Provisional application No. 60/331,085, filed on Oct. 22, 2001.

(51) Int. Cl.
*A47B 88/00* (2006.01)

(52) U.S. Cl. ..... 312/404

(58) Field of Classification Search ..... 312/400, 312/401, 404, 330.1, 311, 333, 270.3
See application file for complete search history.

(56) References Cited

U.S. PATENT DOCUMENTS

| | | | | |
|---|---|---|---|---|
| 2,132,737 | A | 10/1938 | Kahn | |
| 2,340,762 | A | 2/1944 | Lundin | |
| 3,339,994 | A * | 9/1967 | Reddig et al. | 312/301 |
| 3,883,205 | A * | 5/1975 | Ambaum et al. | 312/330.1 |
| 4,732,435 | A | 3/1988 | Bailey et al. | 312/311 |
| 5,947,573 | A | 9/1999 | Tovar et al. | |

OTHER PUBLICATIONS

International Search Report for PCT/US02/33555; ISA/210 US; Mailed: May, 16, 2003.

* cited by examiner

*Primary Examiner*—James O. Hansen
(74) *Attorney, Agent, or Firm*—Harness, Dickey & Pierce, P.L.C.

(57) ABSTRACT

A refrigerator storage bin includes a main body portion and a cover. The main body portion defines a bin storage area. The cover selectively provides access to the bin storage area. The cover is pivotally attached to a sidewalk of a cabinet of the refrigerator for rotation about a pivot axis between an opened position and a closed position. The cover and main body portion include cooperating surfaces that articulate to cover from the closed position to the open position in response to translation of the main body portion from a first position to a second position.

15 Claims, 3 Drawing Sheets

REFRIGERATION STORAGE BIN INCLUDING FLIP-TOP COVER

CROSS-REFERENCE TO RELATED APPLICATIONS

This application is the national stage patent application which claims priority to International Application No. PCT/US02/33555 filed 21 Oct. 2002 which claims priority to U.S. Provisional Patent Application No. 60/331,085 filed 22 Oct. 2001, which applications are herein expressly incorporated by reference.

FIELD OF THE INVENTION

The present invention generally relates to refrigerators. More particularly, the present invention relates to a refrigerator storage bin, including a flip-top cover. In one particular form, the present invention relates to a refrigerator storage bin including a flip-top cover that articulates from a closed position to an open position in response to translation of the storage bin from a retracted position to an extended position.

BACKGROUND OF THE INVENTION

Vehicles including but not limited to recreational vehicles ("RVs"), tractor trailers, airplanes, boats, trains, and the like often incorporate refrigerators for the comfort and convenience of the occupants. Space available for refrigerators on such vehicles is limited and a significant design emphasis has been placed upon maximizing refrigerator storage volume.

Refrigerators, including those designed specifically for vehicles, conventionally incorporate bins for the storage of items. For example, such storage bins are commonly used to retain produce. Within the bin, produce and the like can be randomly placed and stacked such that the storage volume is not entirely limited by the square area of a support surface (e.g., shelf or cabinet bottom). Explaining further, the walls of the storage bin cooperate to effectively and efficiently retain produce and other goods within the refrigerator. Many known refrigerator storage bins are equipped with covers. Such conventional covers retain moisture within the bin to preserve freshness, otherwise protect the bin contents, and contribute to an organized appearance of an interior of the refrigerator.

Accordingly, it remains a need in the pertinent art to provide a refrigerator storage bin that overcomes the limitations associated with the prior known arrangements, including but not limited to those disadvantages discussed above.

SUMMARY OF THE INVENTION

It is a general object of the present invention to provide a refrigerator storage bin including a cover that articulates from a closed position to an open position in response to translation of the storage bin from a retracted position to an extended position.

It is a related object of the present invention to provide a storage bin for a refrigerator having a cover that is pivotally connected to a cabinet of the refrigerator.

In one particular form, the present invention provides a refrigerator storage bin including a main body portion and a cover. The main body portion defines a bin storage area. The cover selectively provides access to the bin storage area. The cover is pivotally attached to a sidewal of a cabinet of the refrigerator for rotation about a pivot axis between an opened position and a closed position. The cover and main body portion include cooperating surfaces that articulate to cover from the closed position to the open position in response to translation of the main body portion from a first position to a second position.

Additional advantages and features of the present invention will become apparent from the following description and appended claims, taken in conjunction with the accompanying drawings.

Further areas of applicability of the present invention will become apparent from the detailed description provided hereinafter. It should be understood that the detailed description and specific examples, while indicating the preferred embodiment of the invention, are intended for purposes of illustration only and are not intended to limit the scope of the invention.

BRIEF DESCRIPTION OF THE DRAWINGS

The present invention will become more fully understood from the detailed description and the accompanying drawings, wherein.

DETAILED DESCRIPTION OF THE PREFERRED EMBODIMENTS

Figure 1:
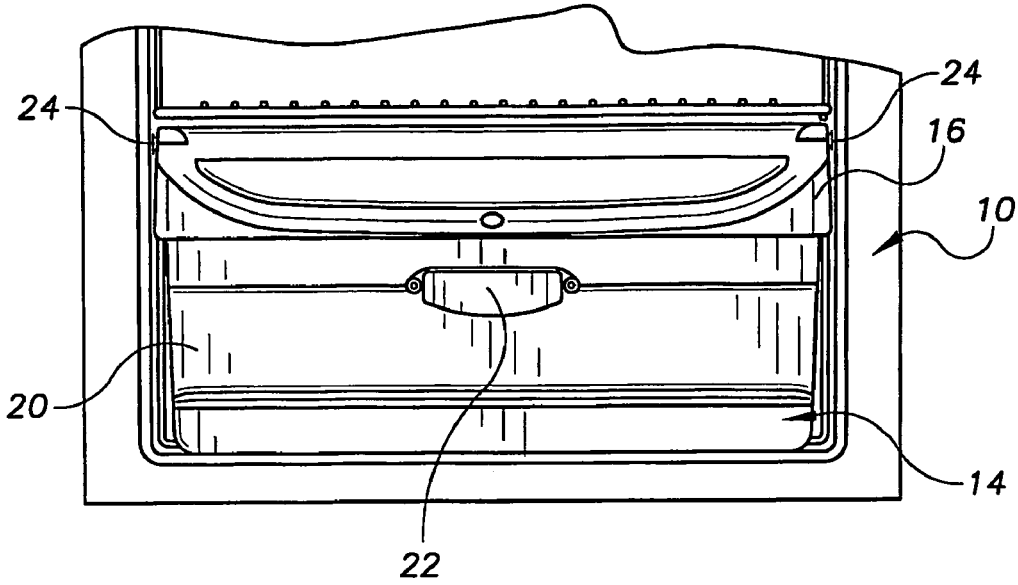
FIG. 1 is a front view of a storage bin for a refrigerator including a cover constructed in accordance with the teachings of a preferred embodiment of the present invention, the storage bin shown in a fully stored position and the cover articulated to a closed position.

The following description of the preferred embodiment of the present invention is merely exemplary in nature and is in no way intended to limit the invention, its application, or uses.

With reference to the drawings, a refrigerator storage bin constructed in accordance with the teachings of a preferred embodiment of the present invention is illustrated and generally identified at reference character 10. The storage bin 10 is shown throughout the drawings associated with a cabinet 12 of a refrigerator. It will be understood by those skilled in the art that the particular cabinet illustrated is exemplary in nature and that the subject invention is not limited thereto.

The storage bin 10 is illustrated to generally include a main body portion 14, a cover 16, the main body portion 14 defines a bin storage area 18. The main body portion 14 is generally rectangular in shape and includes a forward side 20 having a handle 22.

Figure 2:
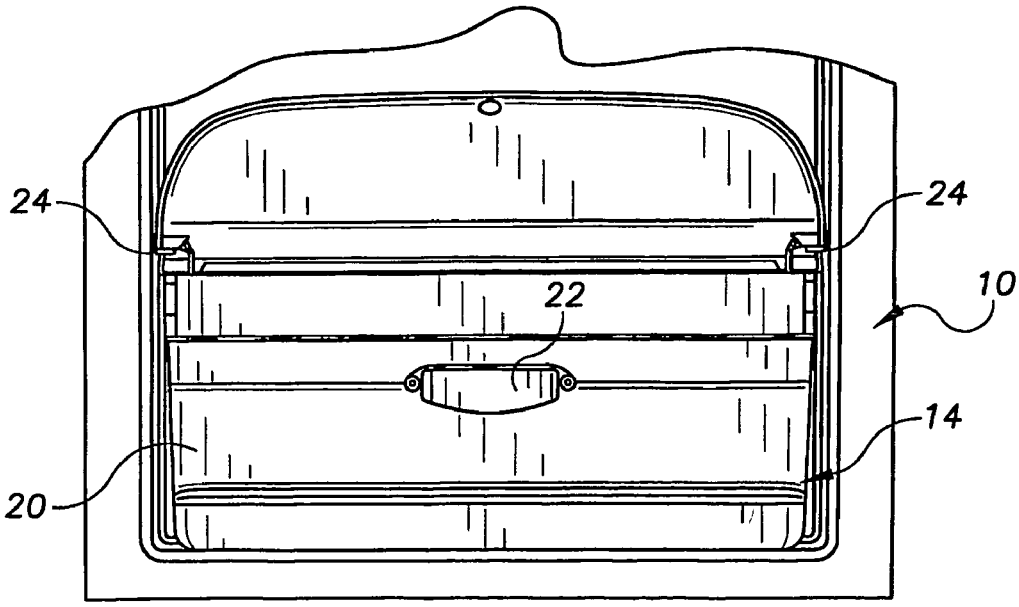
FIG. 2 is a front view of the storage bin of the present invention illustrated translated to a fully extended position and the cover articulated to an open position.

The main body portion 14 is translatable between laterally opposed sidewalls 23 of the cabinet 12 between a first or retracted position and a second or extended position. In the retracted position, shown for example in FIGS. 1 and 5, the main body portion 14 is disposed completely within the cabinet 12. In the extended position shown in FIGS. 2 and 7, the main body portion 14 partially extends from the cabinet 12. An intermediate position is illustrated in FIG. 6.

Figure 4:
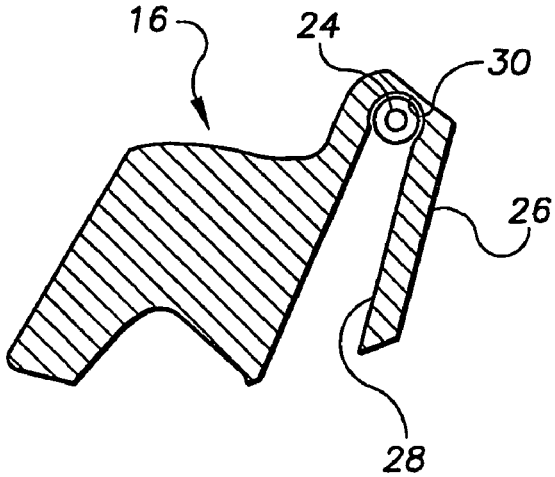
FIG. 4 is a cross-sectional view taken through a portion of the cover and a pivot pin.

The cover 16 is operative for selectively providing access to the bin storage area 18. The cover 16 is pivotally attached to the opposing sidewalls of the cabinet 12 with a pair of pivot pins 24. Explaining further, both of the lateral sides of the cover 16 include a downwardly extending leg 26 (shown perhaps most clearly in the cross-sectional view of FIG. 4). The downwardly extending legs 26 are spaced apart from an adjacent main portion of the cover 16 so as to define an opening 28 therebetween.

At a point of the cover 16 whereat the downwardly extending leg 26 engages the remainder of the cover 16, a closed end 30 of the opening 28 is defined which is generally circular. The diameter of the end 30 is substantially equal to the diameter of the associated pivot pin 24. The opening 28 tapers slightly leading to the end 30 such that a portion of the opening 28 immediately adjacent the end 30 has a width slightly less than the pin diameter. In this manner, the opening 28 can be easily located by the pivot pin 24 during installation of the cover and the pivot pin 24 is received in a snap-fit relationship within the opening 30. In this manner, the cover 16 is pivotally retained on the pivot pin 24 independent of the main body portion 14.

Figure 3:
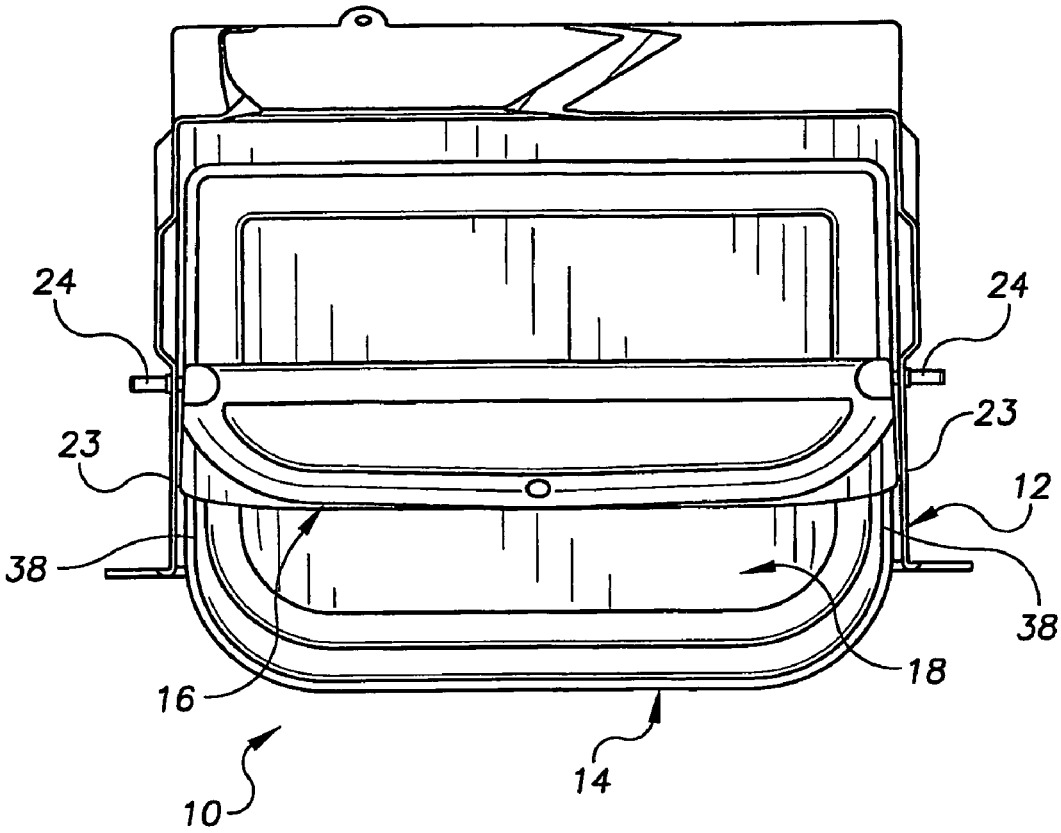
FIG. 3 is a top view of the storage bin of the present invention translated to the fully extended position.
Figure 5:
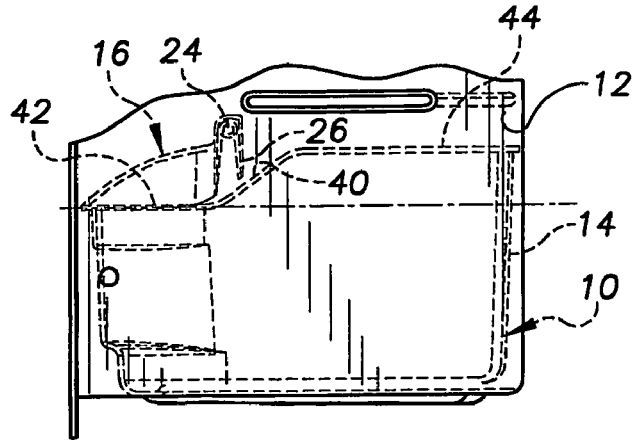
FIG. 5 is a side view of the storage bin of the present invention shown translated to a fully stored position.
Figure 6:
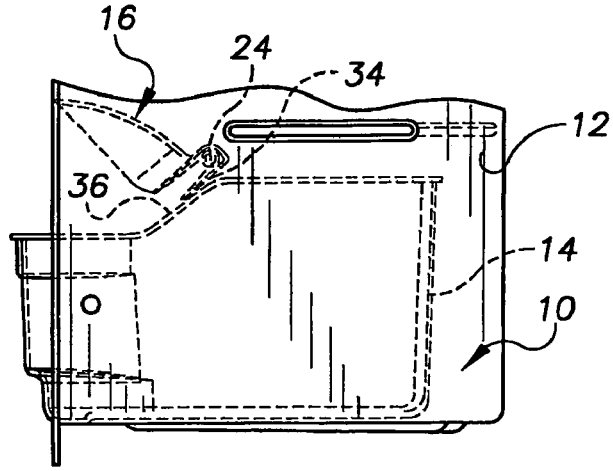
FIG. 6 is a side view of the storage bin of the present invention shown translated to a partially extended position.
Figure 7:
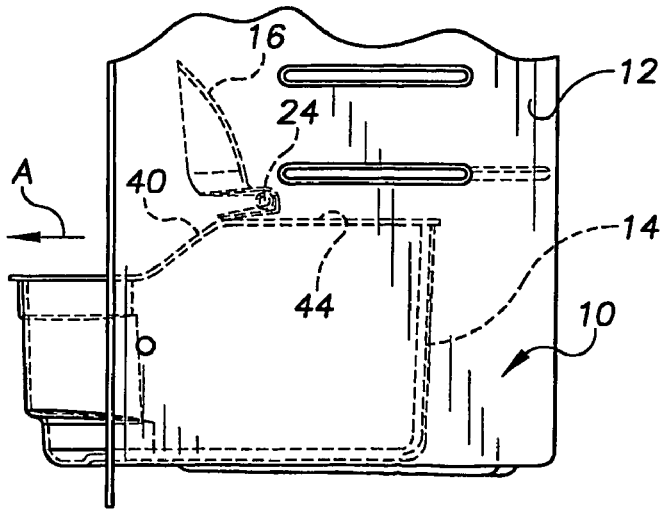
FIG. 7 is a side view of the storage bin of the present invention shown translated to a fully extended position.

The cover 16 and the main body portion 14 include cooperating surfaces 34 and 36, respectively (see FIG. 6). The cooperating surfaces 34 and 36 serve to articulate the cover 16 from the closed position to the open position in response to translation of the main body portion 14 from the retracted position to the extended position. The cooperating surface 34 of the cover 16 is defined by a lower and rear side of the downwardly extending legs 26. The cooperating surface 36 of the main body portion 14 includes an upper edge of the opposed sidewalls 38 (see FIG. 3) of the main body portion 14. The upper ends include an intermediate curvilinear segment 40 (see FIG. 5) which transitions between a first generally horizontal portion 42 and a higher, second generally horizontal portion 44.

When the main body portion 14 of the storage bin 10 is in its retracted position (as shown in FIG. 5), the main portion of the cover 16 rests on the horizontal portion 42 of the upper end of the sidewalls and the cover 16 prevents access to the storage bin 18. As the main body portion 14 is manually translated from the retracted position toward the extended position, the downwardly extending legs 26 of the cover 16 engage the curvilinear portion 40 and thereby cause the cover 16 to articulate about the pivot axis defined by the pivot pins 24 in a clockwise direction (as shown in FIG. 6). Further translation of the main body portion 14 causes corresponding clockwise rotation of the cover 16 due to the increased height of the portion of the curvilinear segment 40 that engages the downwardly extending legs 26. As the downwardly extending legs 26 reach the upper horizontal portions 44 of the upper ends of the sidewalls 38, the cover 16 is articulated to its fully open position (shown in FIG. 7). At this point, the main body portion 14 can be further translated in the direction of arrow A (see FIG. 7) and thereby be removed completely from the cabinet 12.

In the exemplary embodiment illustrated, both the main body portion 14 and the cover 16 are constructed of a substantially rigid plastic. The cover 16 is preferably translucent. Alternatively, other known materials may be incorporated.

The description of the invention is merely exemplary in nature and, thus, variations that do not depart from the gist of the invention are intended to be within the scope of the invention. Such variations are not to be regarded as a departure from the spirit and scope of the invention.

The invention claimed is:

1. A refrigerator storage bin in combination with a refrigerator, the storage bin comprising:

a main body portion defining a bin storage area; and a cover selectively providing access to the bin storage area, the cover being pivotally coupled to a sidewall of a cabinet of the refrigerator for rotation about a pivot axis between an open position and a closed position, the cover positioned over the main body portion in the closed position, the cover including a rear portion with a surface that cooperates with a portion of an upper surface of the main body portion through sliding engagement therebetween to articulate the cover from the closed position to the open position in response to translation of the main body portion from a first position to a second position, the portion of the upper surface cooperates with the cover through sliding engagement being spaced from a front face of the main body portion;

the cooperating surface of the cover is disposed proximate the fixed pivot axis, and the cover includes at least one downwardly extending leg, the at least one downwardly extending leg defining the surface of the cover that cooperates with the upper surface;

wherein the at least one leg is spaced from a remainder of the cover to define an opening therebetween, the opening receiving a pivot pin extending from the sidewall of the cabinet.

2. The refrigerator storage bin of claim 1, wherein the pivot axis is fixed relative to the cabinet.

3. The refrigerator storage bin of claim 1, wherein the upper surface of the main body portion includes an intermediate segment which transitions between a first generally horizontal portion and a higher, second generally horizontal portion, the intermediate segment slidably engaging the surface to articulate the cover about the pivot axis.

4. The refrigerator storage bin of claim 1, wherein the cover rotates through at least approximately 45° from the closed position to the open position.

5. The refrigerator storage bin of claim 1, wherein the opening tapers slightly to a closed, generally circular end having a diameter, the tapered opening of having a width adjacent the closed, generally circular end slightly less than a diameter of the pivot pin such that the closed, generally circular end receives the pivot pin in a snap-fit relationship.

6. The refrigerator storage bin of claim 1, wherein the surface of the cover is defined by a lower end rear side of the at least one leg.

7. The refrigerator storage bin of claim 1, wherein the cover further includes a forward edge displaced from the main body portion of the bin in the open position.

8. A refrigerator comprising:

a cabinet; and a storage bin disposed in the cabinet and translatable between a stowed position and an extended position, the storage bin having an open top side and a closed front side, the storage bin further having a cover pivotally coupled to a sidewall of the cabinet for automatic rotation about a pivot axis between an open position and a closed position in response to translation from the stowed position to the extended position, the cover including a forward end proximate to the closed front side and a rear portion spaced from the closed front side in the closed position, the rear portion defining a surface that cooperates with a portion of an upper surface of the main body portion to automatically rotate the cover about the pivot axis;

the cover includes at least one downwardly extending leg, the at least one downwardly extending leg defining the surface of the cover that cooperates with the upper surface;

wherein the at least one leg is spaced from a remainder of the cover to define an opening therebetween, the opening receiving a pivot pin extending from the sidewall of the cabinet.

9. The refrigerator storage bin of claim 8, wherein the pivot axis is fixed relative to the cabinet.

10. The refrigerator storage bin of claim 8, wherein the upper surface of the main body portion includes an intermediate segment which transitions between a first generally horizontal portion and a higher, second generally horizontal portion, the intermediate segment slidably engaging the surface to articulate the cover about the pivot axis.

11. The refrigerator storage bin of claim 8, wherein the cooperating surface of the cover is disposed proximate the fixed pivot axis.

12. The refrigerator storage bin of claim 8, wherein the cover rotates through at least approximately 45° from the closed position to the open position.

13. The refrigerator storage bin of claim 8, wherein the opening tapers slightly to a closed, generally circular end having a diameter, the tapered opening of having a width adjacent the closed, generally circular end slightly less than a diameter of the pivot pin such that the closed, generally circular end receives the pivot pin in a snap-fit relationship.

14. The refrigerator storage bin of claim 8, wherein the surface of the cover is defined by a lower end rear side of the at least one leg.

15. The refrigerator storage bin of claim 8, wherein the cover further includes a forward edge displaced from the main body portion of the bin in the open position.

* * * * *